US005342991A

United States Patent [19]

Xu et al.

[11] Patent Number: 5,342,991

[45] Date of Patent: Aug. 30, 1994

[54] FLEXIBLE HYBRID BRANCH CABLE

[75] Inventors: Wills J. Xu, Johnston, R.I.; Michael W. Bricker, Brodbecks, Pa.

[73] Assignee: The Whitaker Corporation, Wilmington, Del.

[21] Appl. No.: 25,536

[22] Filed: Mar. 3, 1993

[51] Int. Cl.[5] ..... H01B 7/08

[52] U.S. Cl. ..... 174/117 R; 174/36; 174/115; 174/117 F

[58] Field of Search ..... 174/36, 117 R, 117 FF, 174/117 F, 115

[56] References Cited

U.S. PATENT DOCUMENTS

| | | | |
|---|---|---|---|
| 4,650,924 | 3/1987 | Kauffman et al. | 174/117 F |
| 4,767,891 | 8/1988 | Biegon et al. | 174/34 |
| 4,847,443 | 7/1989 | Basconi | 174/32 |
| 4,920,234 | 4/1990 | Lemke | 174/36 |
| 4,933,513 | 6/1990 | Lee | 174/115 |
| 4,952,020 | 8/1990 | Huber | 174/117 R |
| 5,025,115 | 6/1991 | Sayegh et al. | 174/117 F |
| 5,043,531 | 8/1991 | Gutenson et al. | 174/49 |
| 5,053,583 | 10/1991 | Miller et al. | 174/36 |
| 5,057,646 | 10/1991 | Nichols et al. | 174/36 |
| 5,084,594 | 1/1992 | Cady et al. | 174/36 |
| 5,097,099 | 3/1992 | Miller | 174/36 |
| 5,142,105 | 8/1992 | Kihlken et al. | 174/112 |
| 5,162,611 | 11/1992 | Nichols, III et al. | 174/36 |
| 5,250,753 | 10/1993 | Schneider | 174/36 |

*Primary Examiner*—Morris H. Nimmo

[57] ABSTRACT

A ribbon cable (2) for a hybrid branch cable (1) . The ribbon cable (2) includes a corrugated binder ribbon (30) which facilitates bundling and encapsulation within a tubular outer casing (50). The binder ribbon (30) is corrugated along sections which bridge the conductors (10–12 and 21–26) carried therein. The pattern of corrugations may be formed in one or both opposing surfaces of the bridging section of the binder ribbon (30) and may include a series of ripples, angled notches, rectangular notches, trapezoidal notches, etc.

26 Claims, 4 Drawing Sheets

FLEXIBLE HYBRID BRANCH CABLE

FIELD OF THE INVENTION

The present invention relates to electrical branch cables and, in particular, to a hybrid branch cable having a plurality of conductors carried in a corrugated binder ribbon. The corrugations facilitate folding of the binder ribbon for bundling within an outer casing.

BACKGROUND OF THE INVENTION

Residential electrical systems are typically served by a variety of different transmission and distribution cables. For example, with communication equipment, entertainment equipment, alarm equipment, etc., each must be connected via numerous power lines, control lines, and analog and digital communication lines. A confusion of incoming cables often results.

Hybrid branch cables were introduced to eliminate the clutter of discrete cables. Hybrid branch cables are singular cables which carry a multitude of internal conductors. The conductors are devoted to different purposes including 110 volt, 60 Hz power, data communication, and control. U.S. Pat. No. 5,053,583 issued to Miller et al. discloses an exemplary bundled hybrid ribbon cable in which a flat ribbon cable of multiple conductors is rolled and bundled in a generally tubular outer casing. The ribbon cable provides for ease of termination while the bundled tubular configuration facilitates installation and routing of the hybrid cable through the framework of the dwelling.

To further facilitate installation, hybrid branch cables must be as flexible as possible. However, the various signal conductors, power conductors, etc., all detract from the cable's flexibility. Moreover, the close proximity of the internal conductors generates cross-talk, and this necessitates an internal shield which further detracts from the flexibility of the cable. For example, the intertwined foil layer suggested in the above-described '583 patent severely increases the rigidity of the cable along its axis.

U.S. Pat. No. 5,097,099 issued to Miller discloses a partial solution in the form of a composite fiber shield. The composite shield serves to protect the conductors from electromagnetic interference (EMI), yet the fibrous nature does not severely limit the axial rigidity of the bundled cable. The proposed improvement is limited to the shield. This leaves room for further flexibility of other components of the cable.

More specifically, the manufacture of hybrid bundled cables includes rolling of the ribbon cable prior to encasement in the outer shell. The installation and repair of such cables requires stripping of the shell, unrolling of the ribbon cable and positioning of the conductors. Given the frequent need to manipulate the internal ribbon cable, it would be greatly advantageous to increase its flexibility to facilitate folding and unfolding. The present invention provides an innovative solution.

SUMMARY OF THE INVENTION

The present invention provides an improvement in a ribbon cable which facilitates bundling in a hybrid branch cable configuration.

The ribbon cable includes a flexible insulative ribbon binder which envelopes a plurality of conductors and maintains them in a parallely-spaced side-by-side relationship. The ribbon binder is formed with a pattern of corrugations along one or more of the section(s) bridging adjacent conductors which facilitate folding of the ribbon binder for further enclosure within a tubular outer casing.

The pattern of corrugations may include rippled furrows, angular grooves, rectangular notches, trapezoidal notches, or any other suitable pattern, and the corrugations may be formed along one or both surfaces of the bridge section(s) of the ribbon binder in order to achieve a desired degree of flexibility.

Other advantages and results of the invention are apparent from a following detailed description by way of example of the invention and from the accompanying drawings.

DETAILED DESCRIPTION OF THE PREFERRED EMBODIMENT

Figure 1:
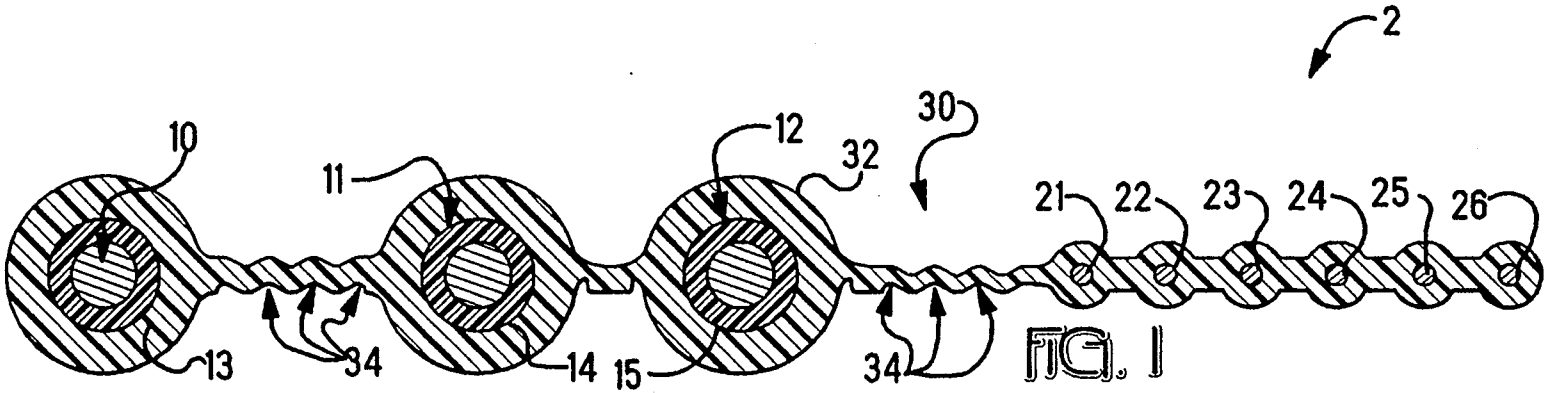
FIG. 1 is a sectional view of an exemplary flat multi-conductor ribbon cable 2 prior to enclosure within an outer casing.

With more particular reference to the drawings, FIG. 1 is a sectional view of an exemplary flat multi-conductor ribbon cable 2 which is especially suited for use in a bundled hybrid cable. Ribbon cable 2 is formed in an initially flat configuration and may carry upward of sixteen separate conductors all embedded in a flexible insulating binder ribbon 30. For purposes of illustration, three power conductors 10–12 are shown along with six signal conductors 21–26, and all are held in a spaced side-by-side configuration by binder ribbon 30.

In practice, the ribbon cable 2 may be formed by extruding the insulating ribbon around the individual conductors 10–12 and 21–26. Each of the conductors 10–12 and/or 21–26 may additionally be provided with an auxiliary layer of insulative coating. For example, in the illustrated embodiment, each of the power conductors 10–12 is enclosed within an auxiliary insulating layer 13–15, respectively. The insulating binder ribbon 30 is extruded around the auxiliary insulating layers 13–15. In conventional practice, all of the individual conductors carried within the extruded binder ribbon 30 are enclosed by color coded auxiliary insulative coatings. The following table lists sixteen typical conductors and a corresponding color scheme for each.

TABLE I

| | | | |
|---|---|---|---|
| 1 | Telephone Line #1 | Black | 24 Gauge |
| 2 | Telephone Line #1 | Red | 24 Gauge |
| 3 | Telephone Line #2 | Green | 24 Gauge |
| 4 | Telephone Line #2 | Yellow | 24 Gauge |
| 5 | +12 Volts DC | Black | 18 Gauge |
| 6 | −12 Volts DC | White | 18 Gauge |
| 7 | Data #1 | Purple | 24 Gauge |
| 8 | Data #2 | Brown | 24 Gauge |
| 9 | Data Ground | Green/Yellow Stripes | 24 Gauge |
| 10 | Clock #1 | Brown | 24 Gauge |
| 11 | Clock #2 | Orange | 24 Gauge |
| 12 | Power Neutral | White | 12 or 14 Gauge |
| 13 | Power Ground | Green | 12 or 14 Gauge |
| 14 | Power Hot | Black | 12 or 14 Gauge |
| 15 | Coax #1 | White | N/A |
| 16 | Coax #2 | Black | N/A |

The initially flat ribbon cable configuration as shown in FIG. 1 provides significant mass termination economies. This is because contacts may be made to all of the individual conductors by a single application of multiple insulation piercing or displacing contacts. The same one-step procedure is not possible with a bundle cable having a circular cross-section. On the other hand, flat ribbon cables are unwieldy during conventional electrical wiring installation. Conventional round cables are preferred since it is easier to drill round holes within a stud framework. The flat hybrid cable of FIG. 1 according to the present invention is well suited for bundling into a round cable configuration. This is easily accomplished simply by folding the flat ribbon cable 2 upon itself and by further enveloping the folded ribbon cable 2 in a tubular jacket.

It should be apparent that folding of the ribbon cable 2 will bring the conductors in closer proximity. The signal conductors 21–26 will be adjacent the power conductors 10–12, and this invites cross-talk. In an effort to prevent cross-talk and interference, a shielding member 40 may be laid about portion of the ribbon cable 2 prior to folding.

Figure 2:
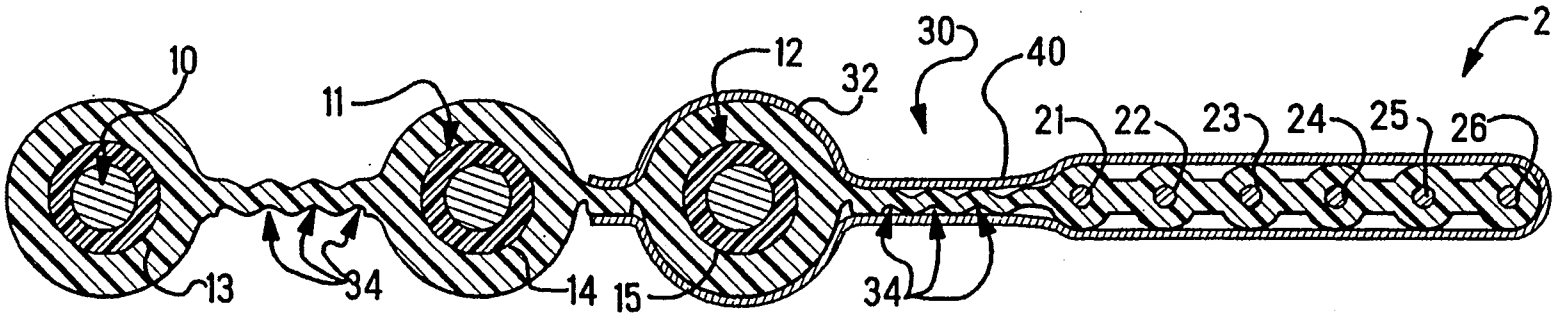
FIG. 2 is a sectional view as in FIG. 1 also showing the initial placement of a shielding member 40 on the multi-conductor ribbon cable 2 of FIG. 1.

As shown in FIG. 2, shielding member 40 is layered around the section of the ribbon cable 2 which envelops conductors 21–26. The shielding member 40 also extends around and envelops power conductor 12. Shield 40 may be made of any suitable metallic conductive film of the type conventionally used to shield electromagnetic interference (EMI). To further facilitate folding of the ribbon cable 2, the shielding member 40 may be a woven web such as shown and described in U.S. Pat. No. 5,097,099 issued to Miller.

Figure 3:
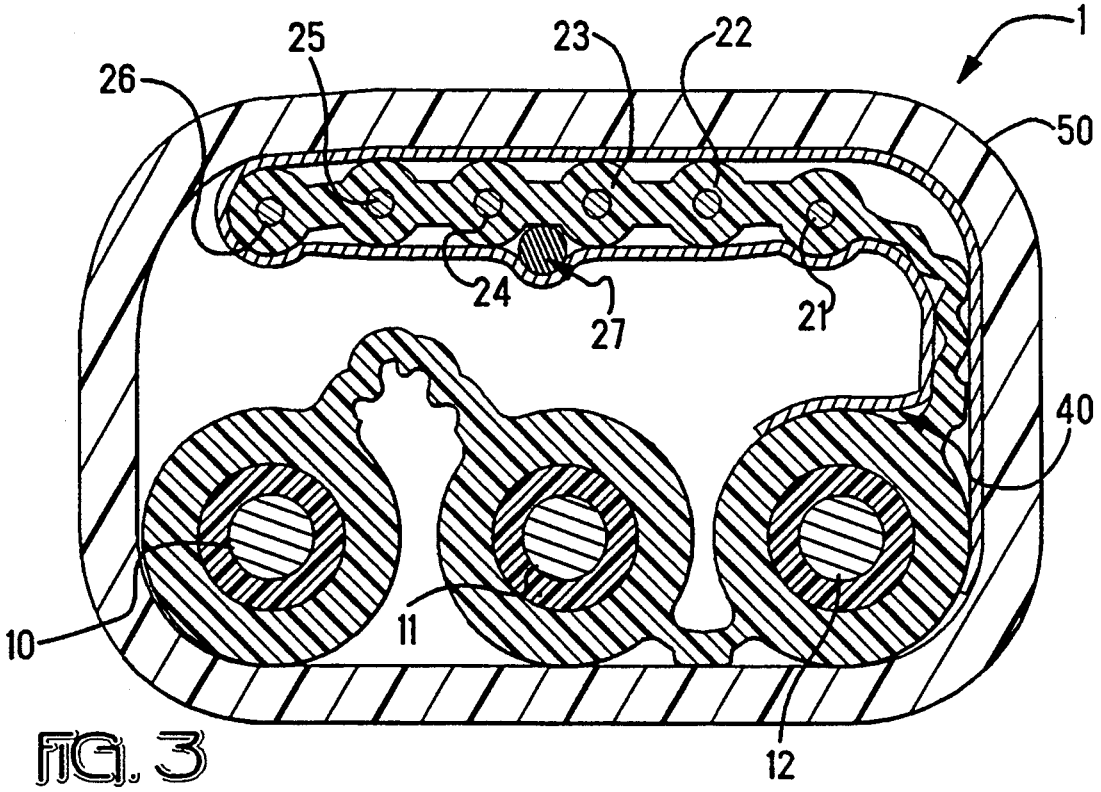
FIG. 3 is a sectional view of a folded and assembled hybrid cable 1 including a multi-conductor ribbon cable 2 bundled within a dielectric outer casing 50.

As shown in FIG. 3, the section of the ribbon cable carrying conductors 21–26 along with the shield 40 is folded over the power conductors 10–12. To conserve space, power conductors 10 and 11 should be compressible toward each other. The entire ribbon cable 2 is then further encapsulated within a tubular outer casing 50.

FIG. 3 also shows an additional 18 gauge drain wire 27 for purposes of illustrating that drain wires may be run between the binder ribbon 30 and the shielding member 40.

The result is a bundled hybrid cable 1 which may be easily routed throughout the stud framework during construction of a residence. The bundled shield 40 protects the signal conductors 21–26 from the power conductors 10–12 and from external electromagnetic interference (EMI).

In accordance with the present invention, the sections of the ribbon cable 2 which bridge the discreet conductors 10–12 and/or 21–26 are corrugated to facilitate the above-described bundling operation as well as subsequent unfolding.

In the exemplary embodiment of FIG. 3, the two most crucial bridge sections of the binder ribbon 30 are corrugated, i.e., the bridge section occurring between the two outermost power conductors 10 and 11, and the bridge section occurring between the innermost power conductor 12 and the innermost signal conductor 21. The corrugations at the first of the two bridge sections ensure that the spacing between the two power conductors 10 and 11 may be adjusted as necessary to fit within the outer casing 50. The corrugations at the second of the two bridge sections facilitates folding of the binder ribbon 30 during the bundling operation. Both corrugated bridge sections greatly contribute to the flexibility of the flat ribbon cable and thereby allow convenient folding and extrusion of outer jacket 50 thereabout.

Figure 4:
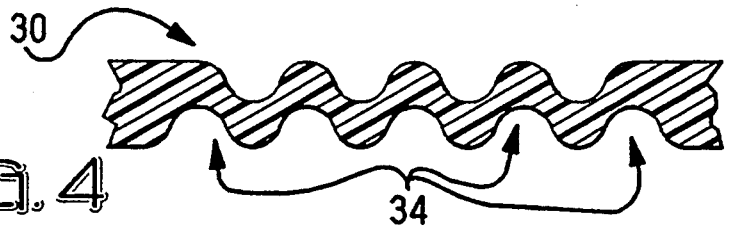
FIG. 4 is an enlarged sectional view of a portion of the ribbon binder 30 of FIGS. 1–3 showing the corrugations 34 which increase the resiliency thereof.

The corrugations themselves may be formed in a variety of different configurations, and an exemplary collection is shown in FIGS. 4–14. For example, as shown in FIG. 4, the pattern of corrugations 30 is defined by a series of rippled furrows 34 formed in the two opposing surfaces of the bridge section of the binder ribbon.

The degree of flexibility may be altered by varying the pattern of corrugations 30 in terms of number, size, and/or shape. For instance, less flexibility is obtained by reducing the number of corrugations.

The degree of flexibility may be further adjusted by varying the alignment of the furrows on opposing sides. A certain flexibility results from the illustrated pattern of FIGS. 1–4 where the furrows on one side of binder ribbon 30 conform to the crests on the other side. Conversely, the furrows on one side of binder ribbon 30 may alternatively conform to the furrows on the other side, and the crests to the crests.

Figure 5:
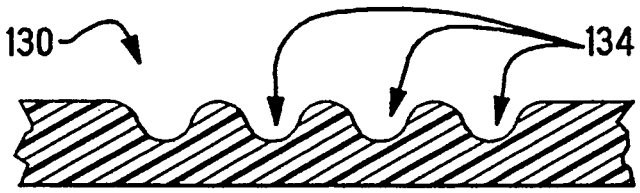
FIG. 5 is an enlarged sectional view of a ribbon binder 130 having an alternative arrangement of corrugations 134.

FIG. 5 illustrates how the degree of resiliency can be reduced by forming corrugations 134 in only one of the two surfaces of the binder ribbon 30.

Figure 6:
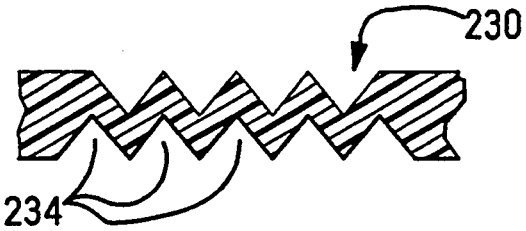
FIG. 6 is an enlarged sectional view of a ribbon binder 230 having another alternative arrangement of corrugations 234.

The shapes of the corrugations may themselves be altered. For example, FIG. 6 illustrates an alternative shape wherein each corrugation comprises an angular groove 234. As before, the respective angular grooves 234 may be formed along one or both surfaces of binder ribbon 230, and their alignment may be altered to determine the overall degree of flexibility.

Figure 7:
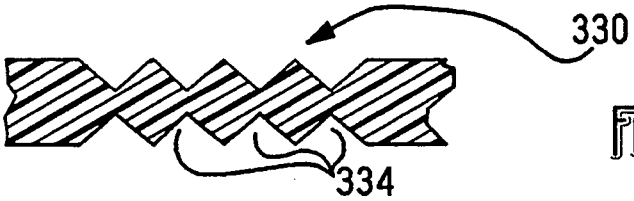
FIG. 7 is an enlarged sectional view of a ribbon binder 330 having another alternative arrangement of corrugations 334.

FIG. 7 illustrates a binder ribbon 330 which is a variation on that of FIG. 6. The crests of the corrugations 334 along one surface conform to the crests of the opposing surface, and the grooves 334 conform to the grooves. This way, the thickness of binder ribbon 330 is minimal at the grooves, and flexibility is maximized.

Figure 8:
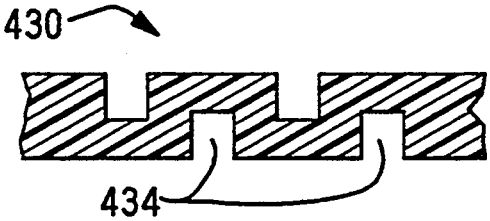
FIG. 8 is an enlarged sectional view of a ribbon binder 430 having another alternative arrangement of corrugations 434.
Figure 9:
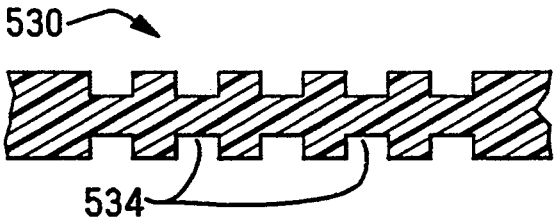
FIG. 9 is an enlarged sectional view of a ribbon binder 530 having another alternative arrangement of corrugations 534.
Figure 10:
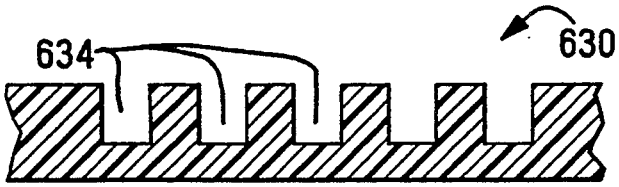
FIG. 10 is an enlarged sectional view of a ribbon binder 630 having another alternative arrangement of corrugations 634.

FIGS. 8–10 illustrate further alternative configurations of corrugation patterns all including channels of rectangular cross-section.

In FIG. 8, the channels 434 on one side of binder ribbon 430 conform to the crests on the other side.

As shown in FIG. 9, the channels 534 on one side of binder ribbon 530 may alternatively conform to the channels on the other side, and the crests to the crests.

In FIG. 10, the channels 634 are formed on only one side of binder ribbon 630.

Figure 11:
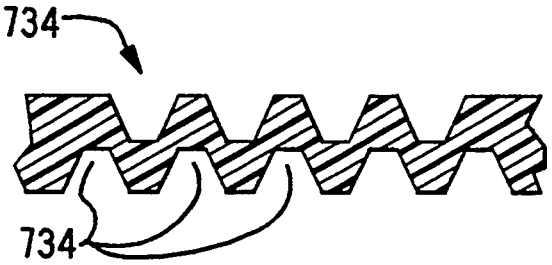
FIG. 11 is an enlarged sectional view of a ribbon binder 730 having another alternative arrangement of corrugations 734.
Figure 12:
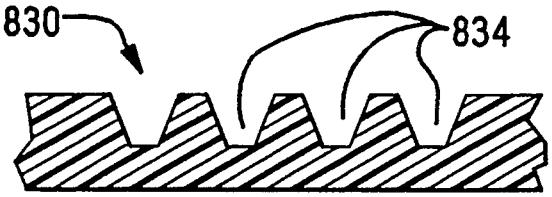
FIG. 12 is an enlarged sectional view of a ribbon binder 830 having another alternative arrangement of corrugations 834.
Figure 13:
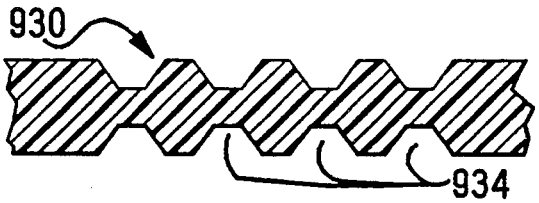
FIG. 13 is an enlarged sectional view of a ribbon binder 930 having another alternative arrangement of corrugations 934.

FIGS. 11–13 show three additional alternative patterns of corrugations. Just as in the previous patterns of FIGS. 8–10, the patterns of FIGS. 11–13 have rectilinear cross-sections. However, the corrugations of FIGS. 11–13 comprise trapezoidal channels and crests.

In FIG. 11, the trapezoidal channels 734 are formed along both surfaces of binder ribbon 730, and the channels 734 on one side of binder ribbon 730 conform to the crests on the other side.

In FIG. 12, the trapezoidal channels 834 are shown along only one surface of binder ribbon 830.

Once again, the channels and crests on opposing sides of the binder ribbons may be offset or aligned to alter the degree of flexibility.

For instance, in FIG. 13 the trapezoidal channels 934 are formed along both surfaces of binder ribbon 930. However, the channels 934 on one side of binder ribbon conform to the channels on the other side.

Figure 14:
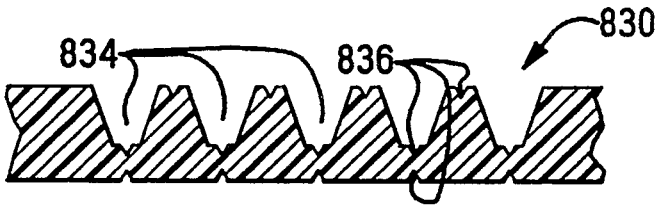
FIG. 14 is an enlarged sectional view of a ribbon binder 830 as in FIG. 12 with the addition of auxiliary notches 836.
Figure 15:
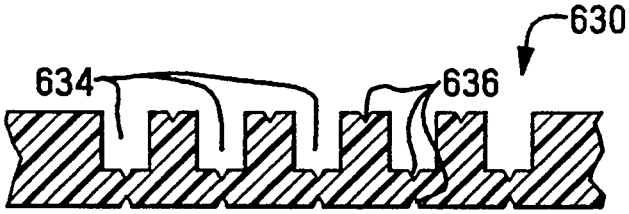
FIG. 15 is an enlarged sectional view of a ribbon binder 630 as in FIG. 10 with auxiliary notches 636.

FIGS. 14 and 15 show auxiliary notches 836 and 636 formed in the rectangular and trapezoidal corrugations 834 and 634 of FIGS. 12 and 10, respectively. It should be noted that similar auxiliary notches may be incorporated in virtually any pattern of corrugations, including any of the corrugations illustrated in the present application. The auxiliary notches 836 and 636 may be formed within the depression and/or at the crest of each corrugation. In addition, the notches may be formed along one or both surfaces of the binder ribbons 830 and 630 (whether corrugated or not). The auxiliary notches serve to increase the flexibility beyond that attained by corrugations alone, and the added flexibility is gained without removing large amounts of plastic. Moreover, the auxiliary notches serve as convenient guides for cutting the respective binder ribbons.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

We claim:

1. An improvement in a ribbon cable having a plurality of conductors parallely maintained in a spaced side-by-side relationship by a flexible insulative binder ribbon, said binder ribbon enveloping each of said conductors and bridging adjacent conductors, the improvement comprising:

a pattern of corrugations formed in at least one bridging section of said binder ribbon to facilitate folding of said binder ribbon for further enclosure within a tubular outer casing.

2. The improvement of claim 1 wherein said pattern of corrugations further comprises a plurality of rippled furrows formed along a first surface of the bridging section of said binder ribbon.

3. The improvement of claim 2 wherein said pattern of corrugations further comprises a corresponding plurality of rippled furrows formed along an opposing second surface of the bridging section of said binder ribbon.

4. The improvement of claim 3 wherein the rippled furrows formed along said first surface and said second surface define alternating crests and troughs along the respective surfaces, and the crests and troughs along said first surface oppose the respective crests and troughs along the second surface.

5. The improvement of claim 3 wherein the rippled furrows formed along said first surface and said second surface define alternating crests and troughs along the respective surfaces, and the crests and troughs along said first surface oppose the respective troughs and crests along the second surface.

6. The improvement of claim 1 wherein said pattern of corrugations further comprises a plurality of angular grooves formed along a first surface of the bridging section of said binder ribbon.

7. The improvement of claim 6 wherein said pattern of corrugations further comprises a corresponding plurality of angular grooves formed along an opposing second surface of the bridging section of said binder ribbon.

8. The improvement of claim 7 wherein the angular grooves formed along said first surface are substantially aligned with the angular grooves formed along the second surface.

9. The improvement of claim 7 wherein the angular grooves formed along said first surface are offset from the angular grooves formed along the second surface.

10. The improvement of claim 1 wherein said pattern of corrugations further comprises a plurality of channels of rectilinear cross-section formed along a first surface of the bridging section of said binder ribbon.

11. The improvement of claim 10 wherein said channels are further defined by a trapezoidal cross-section.

12. The improvement of claim 10 wherein said pattern of corrugations further comprises a corresponding plurality of channels of rectilinear cross-section formed along an opposing second surface of the bridging section of said binder ribbon.

13. The improvement of claim 12 wherein the channels formed along said first surface are substantially aligned with the channels formed along the second surface.

14. The improvement of claim 12 wherein the channels formed along said first surface are offset from the channels formed along the second surface.

15. The improvement of claim 11 further comprising a shallow notch formed between each of said channels.

16. The improvement of claim 11 further comprising a shallow notch formed within each of said channels.

17. A bundled cable comprising:

a plurality of conductors;

a binder ribbon for binding said plurality of conductors in a parallel side-by-side relationship, the binder ribbon comprising a flexible insulative ribbon enveloping each of said conductors and bridge adjacent conductors, and said binder ribbon further having a pattern of corrugations formed in at least one bridging section thereof to facilitate folding of said binder ribbon; and a tubular outer casing around a folded length of said binder ribbon.

18. The bundled cable of claim 17 wherein said pattern of corrugations further comprises a plurality of rippled furrows formed along the bridging section of said binder ribbon.

19. The bundled cable of claim 17 wherein said pattern of corrugations further comprises a plurality of angular grooves formed along the bridging section of said binder ribbon.

20. The bundled cable of claim 17 wherein said pattern of corrugations further comprises a plurality of channels of rectilinear cross-section formed along the bridging section of said binder ribbon.

21. The bundled cable of claim 20 wherein said channels are further defined by a trapezoidal cross-section.

22. The bundled cable of claim 17 wherein said plurality of conductors include power conductors and signal conductors.

23. The bundled cable of claim 22 wherein a first bridging section of said binder ribbon between a power conductor and a signal conductor is formed with said corrugations.

24. The bundled cable of claim 23 wherein said binder ribbon is bundled within the tubular outer casing by folding said binder ribbon upon itself at the corrugated first bridging section.

25. The bundled cable of claim 22 wherein a second bridging section of said binder ribbon between two endmost power conductors is formed with said corrugations.

26. The bundled cable of claim 25 wherein said second corrugated bridging section may be contracted within the tubular outer casing to conserve space when bundled therein.

* * * * *